United States Patent [19]

Bailey et al.

[11] Patent Number: 4,963,176

[45] Date of Patent: Oct. 16, 1990

[54] METHOD FOR MAKING GLASS FIBER MATS USING CONTROLLABLE FIBER GLASS STRAND FEEDERS

[75] Inventors: Paul E. Bailey; Shahid Rauf, both of Shelby, N.C.

[73] Assignee: PPG Industries, Inc., Pittsburgh, Pa.

[21] Appl. No.: 418,058

[22] Filed: Oct. 6, 1989

[51] Int. Cl.[5] ..... C03B 37/02

[52] U.S. Cl. ..... 65/4.4; 65/9; 65/29; 65/160; 156/62.4; 156/62.6

[58] Field of Search ..... 65/4.4, 9, 29, 160; 156/62.4, 62.6

[56] References Cited

U.S. PATENT DOCUMENTS 3,340,406 7/1982 Neubauer et al. ..... 65/9

*Primary Examiner*—Robert L. Lindsay
*Attorney, Agent, or Firm*—Richard E. Maebius

[57] ABSTRACT

This invention relates to improvements in making mats of continuous fiber strand using controlled reciprocating strand feeders. More particularly, the invention relates to improvements in making continuous fiber glass strand mats having more uniform density by electronically controlling both the rate of reciprocation and the rate at which strands are deposited onto the surface of a moving conveyor while also reducing the vibration associated with the feeders. Still more particularly, the invention relates to improvements in the production of two continuous fiber glass strand mats, one having uniform mechanical properties while the other possesses directionally dependent ones.

In the preferred embodiment, brushless stepper or indexing motors are used to reverse the direction of reciprocating strand feeders quickly and smoothly so as to minimize their vibration. Also provided are variable speed electric motors in conjunction with a programmable logic controller and frequency inverter to adjust the rate at which strand is deposited by the feeders onto the moving conveyor.

It is shown, by way of example, that these improvements result in increased uniformity of both mat density and thickness.

27 Claims, 7 Drawing Sheets

METHOD FOR MAKING GLASS FIBER MATS USING CONTROLLABLE FIBER GLASS STRAND FEEDERS

This invention relates to improvements in methods for making mats of fiberous material. More particularly, the invention relates to a method for making continuous strand mats using reciprocating strand feeders while independently controlling both the rate of reciprocation and the rate at which the strands are deposited from the feeders onto a moving conveyor so as to form mats of uniform density and thickness. Still more particularly, the invention relates to the production of improved continuous fiber glass strand mats using the reciprocating devices to be described herein.

BACKGROUND OF THE INVENTION

Glass fibers and glass fiber strands have been used before in the art to produce various types of glass fiber mats for use as reinforcement material. The basic principles of mat-making are well known in the art and are fully described in the book entitled "The Manufacturing Technology of Continuous Glass Fibers" by K. L. Lowenstein, published by the Elsevier Publishing Company, 1973 at pages 234 to 251. Typical processes for making mats of continuous fiber glass strands are also described in U.S. Pat. Nos. 3,883,333 (Ackley) and 4,158,557 (Drummond).

Typically, the mats formed by these processes are needled in order to provide sufficient mechanical integrity to the them. In the needling operation, rapidly reciprocating barbed needles are used to cause the individual glass strands which make up the mat to become entangled with one another thus resulting in a mat that can be subsequently handled and processed. The needling operation typically used is described in U.S. Pat. Nos. 3,713,962 (Ackley), 4,277,531 (Picone) and 4,404,717 (Neubauer, et al.) Mechanical integrity can also be imparted to the mat by depositing a resin on its surface and curing or melting the resin so that individual strands are bonded together.

A particular utility for glass fiber mats is in the reinforcement of resinous or polymeric materials. The presence of a glass fiber mat provides increased strength over that of the unreinforced material. Usually, the mat and molten resin are processed together to form a thermosetting or thermoplastic laminate. Thermoplastic laminates are particularly attractive for use in the aircraft, marine, and automotive industries since they may be reheated into a semi-molten state and then stamped into panels of various shapes such as doors, fenders, bumpers and the like. It is of the utmost importance, however, that the glass mat used to make the laminate be as uniform as possible in both its thickness and fiber density as measured in units of ounces per square foot. If a non-uniform mat is used for reinforcement purposes, the reinforced products produced therefrom may have a substantial variation in their strength since some areas may be weaker due to the lack of glass fiber reinforcement while others may be stronger. Even more important is the need to insure that the glass reinforcement flows or moves freely within the thermoplastic laminate during the stamping operation in order to produce uniform strength properties in the final component.

In the production of continuous strand mats by the aforementioned patented processes, a plurality of strand feeders are positioned above a moving belt or conveyor. The conveyor is typically a flexible stainless steel chain. The strand feeders are reciprocated back and forth above the conveyor parallel to one another and in a direction generally across the width of the moving conveyor. Strands of multiple glass fiber filaments are fed to the feeders from a suitable supply source such as a plurality of previously made forming packages held in a support rack generally known in the art as a creel. Each feeder apparatus provides the pulling force necessary to advance the strand from the supply source and deposit it on the surface of the moving conveyor. In a typical production environment, as many as 12 to 16 such strand feeders have been used simultaneously with one another so as to produce a mat with as uniform a density distribution as possible.

It is also well known in the art that the feeder can act as an attenuator to attenuate glass fibers directly from a glass fiber-forming bushing and eventually deposit the strands so formed directly onto a conveyor as described by Lowenstein, supra at pages 248 to 251 and further illustrated in U.S. Pat. Nos. 3,883,333 (Ackley) and 4,158,557 (Drummond).

An example of a simple traversing mechanism is a feeder mounted on a track where the feeder is caused to reciprocate back and forth by an electric motor capable of reversing directions. The equipment used within this type of configuration has inherent limitations on its mechanical durability. First, the feeders are quite heavy, usually weighing between 30 to 50 pounds. When this heavy apparatus is traversed across the width of the conveyor, the traverse speed is limited due to the momentum of the moving feeder and the impact forces which must somehow be overcome or absorbed upon each reversal of direction. This limitation on the speed at which the feeder may traverse across the width of the conveyor may also limit the rate of mat production. Secondly, this constant reciprocating motion of the feeders causes vibration to occur and this can result in a great deal of wear on the feeder mechanisms and their guides which may eventually lead to mechanical failure.

In U.S. Pat. No. 3,915,681 (Ackley), a reduction in the vibration normally associated with the reversal of a feeder was accomplished by the use of a traversing system in which a feeder was caused to reciprocate back and forth along a track. The feeder was advanced by a continuous chain driven by a motor. The chain had affixed to it an extended member or pin which engaged a slot milled into the carriage of the feeder. The slot was positioned so that its length was parallel to the direction of motion of the chain and had a length substantially greater than the diameter of the pin. Thus, the feeder was caused to reciprocate by the continuous motion of the chain since, as the feeder traveled in one direction, the pin exerted the force necessary to advance the feeder by pressing against the periphery of the slot. When the feeder reversed its direction, the pin slid until it contacted the opposite periphery of the slot at which point motion of the feeder was reversed. When the feeder approached the termination point of its reciprocating stroke, it contacted a shock absorber which decelerated it and absorbed the impact due to the change in momentum. Later, as an improvement on the basic design, these shock absorber members were replaced with gas pistons and a reservoir capable of storing the absorbed energy was used to help accelerate the feeder in the opposite direction (See U.S. Pat. No. 4,340,406 (Neubauer, et al.)).

Although such designs were successful in reducing some of the vibration associated with the reciprocation of the feeders, the pin and slot arrangements introduced additional mechanical components that could fail and cause an interruption in the mat-making process. Also, the shock absorbers and gas pistons were mechanical devices inherently incapable of precise and repeatable acceleration and deceleration rates.

A second problem with the systems taught by the prior art was the inconsistency of the mat produced. In the deceleration/acceleration cycle of the feeders, more glass fibers tended to accumulate on the surface of the conveyor near the terminal end of each traverse stroke thus forming a mat tending to be thicker near its edges than in the more central portions thereof.

The reason for the buildup of glass fibers near the mat edges was because that each time the feeder reversed its direction, it was locally resident for a greater duration of time over those portions of the mat where the deceleration/acceleration cycle occurred, i.e., the edges, than it was anywhere else. As long as the feeder was paying out glass strand at a constant rate during the entire duration of the turnaround cycle, then the edges of the mat could do nothing but accumulate a greater thickness of glass than was present in the interior.

In order to produce a finished mat having a more uniform density, it was often necessary to trim the mat as it left the conveyor. This reduced the efficiency of the process by a significant degree since material lost due to trimming was wasted.

Thus, despite the advances made by the prior art, there still exists a need to (1) more rapidly reverse the feeder apparatus during its turnaround cycle, (2) minimize the mechanical vibration associated with a rapid turnaround of the feeder apparatus, and (3) better control mat uniformity and density.

As will now become evident from the remainder of the disclosure, an improved mat making method is provided which satisfies these needs.

SUMMARY OF THE INVENTION

In accordance with the instant invention, an improvement in methods used to make continuous fiber strand mat using controlled reciprocating strand feeders is disclosed. In particular, the instant invention employs the use of conventional reciprocating strand feeders adapted to independently control both the rate of reciprocation and the rate at which the strands are deposited from the feeders onto a moving conveyor so that mats of more uniform density and thickness are formed. Still more particularly, the invention relates to improvements in the production of two continuous fiber glass strand mats, one having uniform mechanical properties while the other possesses directionally dependent ones.

The use of reciprocating strand feeders to produce mats of strand fibers is well known in the art, however, the typical configuration of the equipment used places inherent limitations on its mechanical durability. First, the traverse speed of the feeders is limited due to their momentum and the impact forces which must somehow be overcome or absorbed upon each reversal of direction. Secondly, this constant reciprocating motion of the feeders causes vibration to occur and this can result in a great deal of wear on the feeder mechanisms and their guides which may eventually lead to mechanical failure.

A second problem has been in the consistency of the mat produced using conventional methods. In the deceleration/acceleration cycle of the reciprocating feeders, more fibers tend to accumulate on the surface of the conveyor near the terminal end of each traverse stroke thus forming a mat which is thicker near its edges than in the more central portions thereof.

In order to produce a finished mat having a more uniform density, it was often necessary to trim the mat as it left the conveyor. If the feeders were traversed more rapidly to avoid thickness build-up near the edges of the mat, then the vibration associated with the turnaround cycle would become more severe.

Therefore, it is an object of the instant invention to minimize the mechanical vibration associated with a rapid turnaround of the feeder apparatus and to better control the uniformity of mat density and thickness across the surface of the mat.

This has been accomplished by the use of electronically controlled brushless stepper motors capable of generating enough torque to overcome the momentum associated with the reciprocating feeders in order to reverse their direction quickly and smoothly. Also provided is a variable speed electric motor used in conjunction with a programmable logic controller and frequency inverter to adjust the rate at which strand is deposited by the feeders onto the moving conveyor.

DETAILED DESCRIPTION OF THE DRAWINGS

Figure 2:
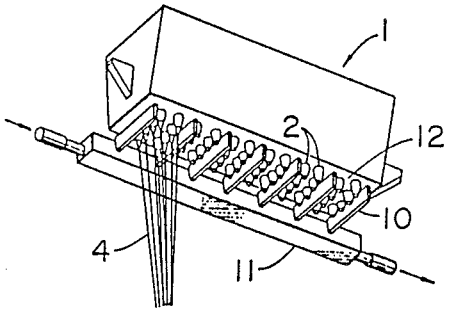
FIG. 2 (PRIOR ART)
FIG. 2 is a perspective view of a bushing, its associated fin coolers, individual tips and fibers emerging therefrom.
Figure 1:
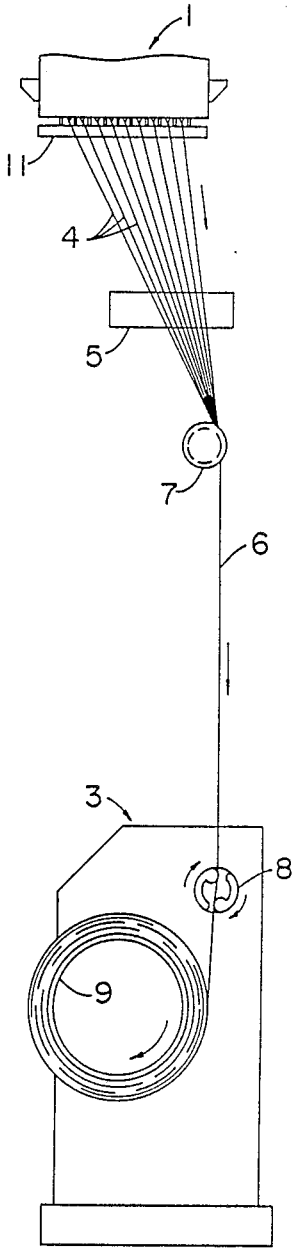
FIG. 1 (PRIOR ART)
FIG. 1 is a general view of a conventional fiber glass forming process showing a bushing, an applicator and a winder.

With reference to the drawings, FIGS. 1 and 2 illustrate a conventional continuous direct draw process for the production of glass fibers wherein molten glass is fed into the top of a bushing assembly (1) and exits from a plurality of tips or orifices (2) to form individual glass cones or jets which are then cooled and attenuated. The drawing force for the attenuation of the cone or jet into an additional filament may be supplied by either an appropriately powered rotating winder (3) or a reciprocating belt attenuator which grips the glass and projects it onto a desired surface such as a continuous conveyor as disclosed in U.S. Pat. Nos. 3,883,333 (Ackley) and 4,158,557 (Drummond).

The individual glass fibers or filaments (4) (hereinafter referred to simply as "fibers"), once they have been cooled sufficiently so as to essentially solidify, are contacted with a roller applicator (5) which coats them with a liquid sizing composition. This sizing composition helps to impart lubricity to the individual fibers and also usually contains a binder which provides a bonding agent. The chemical characteristics of the sizing composition and binder are such that they are compatible with the intended final use of the glass fibers. When a resin such as a thermoplastic resin is to be reinforced with the fibers, then the binder and/or size normally will also include a thermoplastic resin. On the other hand, when the resin to be reinforced is a thermoset resin, the binder and/or size will also normally include one. Resins such as polyesters, polyurethanes, epoxies, polyamides, polyethylenes, polypropylenes, polyvinyl acetates, and the like may also be used.

Two notable resins which are typically reinforced with continuous glass strand mat are polypropylene and nylon. A preferred binder/size system for glass fibers intended to be used for the reinforcement of polypropylene is the size system disclosed in U.S. Pat. No. 3,849,148 (Temple). When continuous glass strand mat is to be used to reinforce a nylon resin, a preferred binder/size system is that disclosed in U.S. Pat. No. 3,814,592 (McWilliams, et al.).

The fibers (4) are then gathered into single or multiple strands (6) by passing a plurality of individual fibers (4) over a gathering shoe (17). The gathering shoe (7) is typically a graphite cylinder or disc having cut therein a plurality of circumferential grooves equal to the number of individual strands to be formed from the fibers produced by a single bushing. Strand (6) is then wound over a rotating spiral (8) and onto a cardboard forming tube (9) which is rotated by an appropriately powered winder (3). The winder (3) may cause either the forming tube (9), spiral (8) or both to reciprocate back and forth along their axis of rotation so that the strand (6) passing over the spiral (8) is laid down along the length of the forming tube (9). Cooling fins (10) are inserted between adjacent rows of tips (2) with one end of each fin being attached to a manifold (11) through which a cooling fluid, such as water, is pumped. The fins (10) are positioned so as to absorb radiative heat from the individual glass cones and conduct it to the manifold (11) where it is removed by the cooling fluid. The fins also remove some heat radiated by the tip plate (12).

Figure 3:
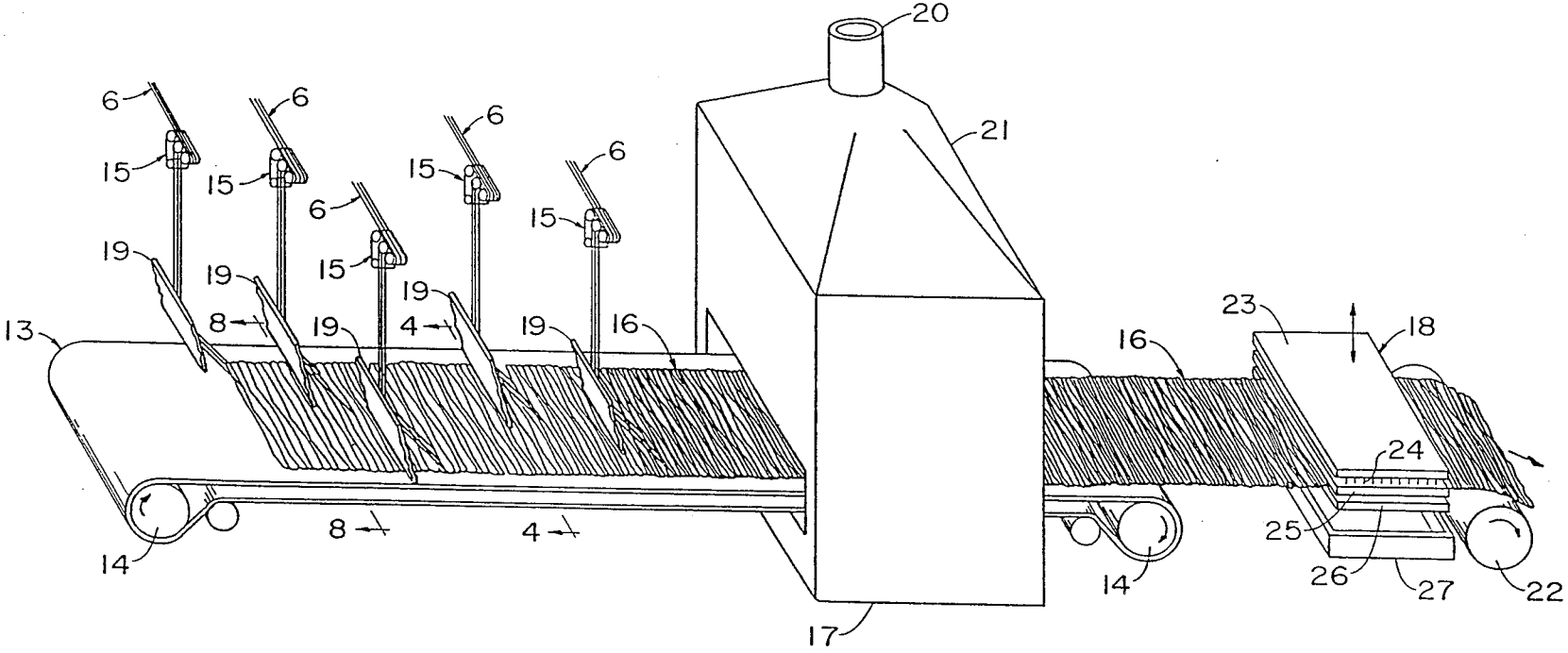
FIG. 3 is a perspective view of a typical mat line used to produce needled continuous strand mat.

FIG. 3 depicts a conveyor (13) which is an endless perforated belt, preferably a stainless steel chain, continuously driven by spaced drive rollers (14). In commercial applications, chain speeds of up to 12 ft/min or greater have been used. Strands (6) are shown being projected downwardly onto the surface of the conveyor by means of a plurality of strand feeders (15). While only five such strand feeders are shown in the drawing, this is for illustrative purposes only, and the actual number used can be greater or lesser. Feeders in excess of those shown may be employed and, in fact, the applicants have successfully employed as many as 16 such individual strand feeders to lay strand onto the conveyor (13).

As is indicated in FIG. 3, each feeder (15) is traversed across a predetermined width of the conveyor (13) until the conveyor is completely covered with strand. Individual strands (6) may be drawn from a plurality of previously made forming packages (9) or from glass fiber bushings in the manner illustrated in U.S. Pat. Nos. 3,883,333 (Ackley) and 4,158,557 (Drummond).

Loose mat (16) is formed by depositing successive layers of strand (6) onto the moving conveyor (13). The conveyor then passes in the direction shown by the arrow through an oven (17) and into a needling loom (18).

In the prior art, strand (6) was deposited from each feeder apparatus (15) directly onto the moving conveyor. While this technique did produce an acceptable mat, it was later found that the strand so deposited often tended to assume a preferred orientation. To overcome this, the use of deflector plates rigidly attached to each feeder apparatus in such a fashion that the strand would impinge upon them and be deflected randomly onto the conveyor was adopted. This produced a mat having more uniform strength. See, U.S. Pat. No. 4,345,927 (Picone). Another type of rigidly attached deflector such as that disclosed in U.S. Pat. No. 4,615,717 (Neubauer, et al.) was later developed to divide the strand into a plurality of filamentary arrays that would be deflected and deposited onto the surface of the conveyor in the form of elongated elliptical loops.

More recently, it has been shown that the use of adjustable stationary deflectors (19) attached to the frame of the mat-making apparatus resulted in an improvement over the prior art while also reducing the momentum associated with the moving feeders (15). (See, U.S. patent application Ser. No. 07/418,005 (Schaefer, et al.) filed Oct. 6, 1989.)

To remove any excess moisture from the strand, the mat is continuously passed through an oven (17). The oven (17) is connected to a duct (20) and provided a heater (not shown) to heat a gas passed through it. The heated gas, preferably air heated to between 70° F. and 140° F., is passed through the hood (21) of the oven (17) which completely covers the width of the conveyor (13) and extends a sufficient distance along it to produce a residence time sufficient to reduce the moisture content of the mat to an acceptable level, usually between 1 to 0.5 percent.

After emerging from the oven (17), the loose mat (16) is usually conveyed from the surface of the conveyor (13) to a needling loom (18). The mat is advanced through the loom by a drive roller (22) which exerts a pulling force on it. The loom (18) has a needle board (23) to which are affixed a plurality of barbed needles (24) typically arranged in rows parallel to one another. The loom (18) is provided with a stripper plate (25) having holes drilled therein so that the needles (24) can be readily reciprocated therethrough. A bed plate (26) on which the mat (16) rests as it passes through the loom (18) is provided which also has a plurality of appropriately sized holes so that the reciprocating needles may pass through them. A tray (27) is also provided to catch any broken glass filaments. The needle board (23) reciprocates up and down as depicted by the arrows so as to push the needles partially through the loose mat (16), stripper (25) and bed plate (26) thereby causing the loose glass strands forming the mat to become entangled with one another.

Figure 4:
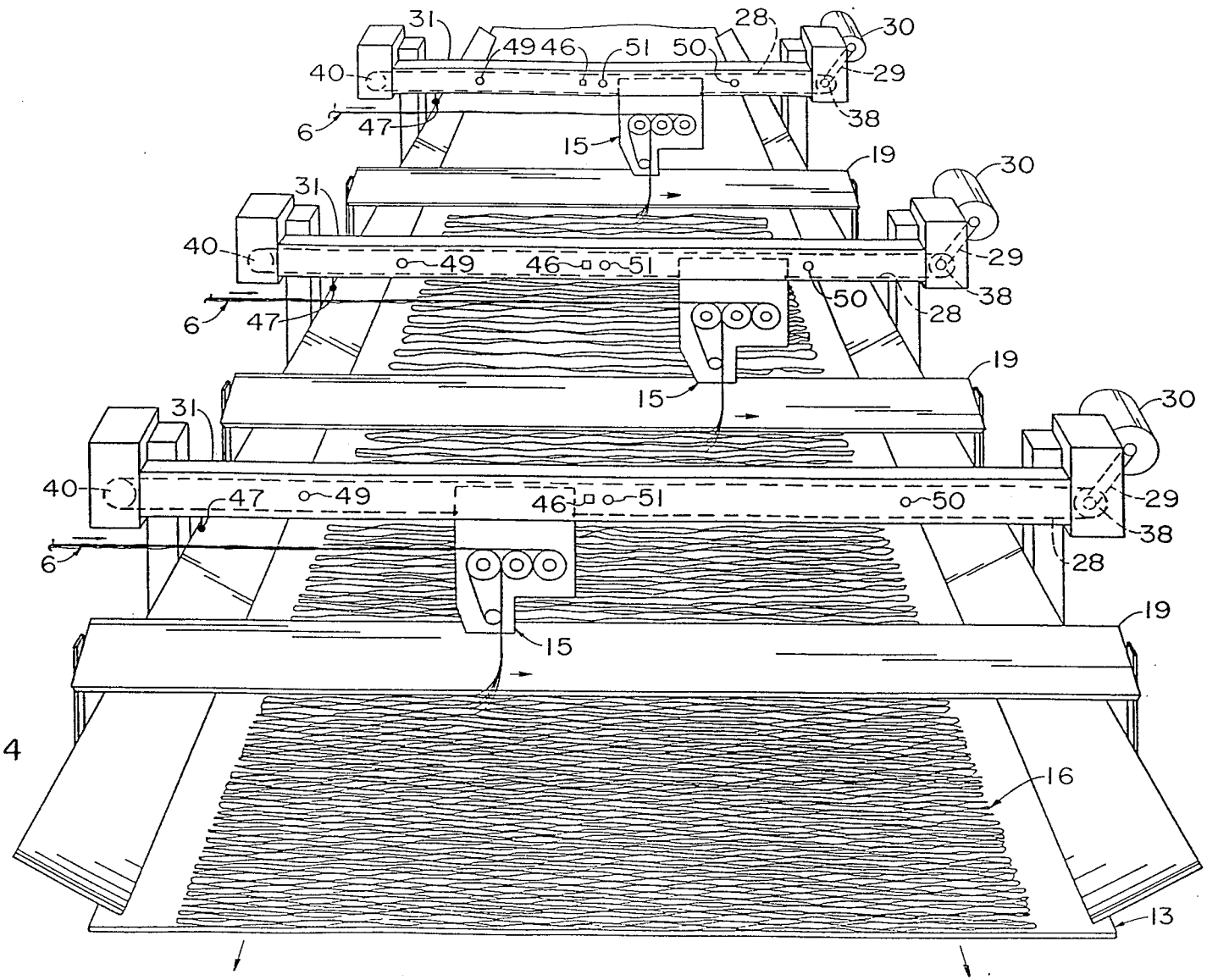
FIG. 4 is a perspective view of the front end of the mat line of FIG. 3 looking into Section 4—4 also showing in detail various components used in the control of the reciprocating feeders.

Turning now to FIG. 4, the individual strands (6) are guided through a plurality of ceramic eyelets (not shown) so as to pass into each feeder (15) where they are projected downwardly from the feeder and deposited onto the surface of the moving chain conveyor (13). A plurality of strands may be provided to each individual feeder (15). The exact number of strands will be determined by the speed of the conveyor (13), number of feeders in operation, and the desired density or thickness of the finished mat.

In the preferred embodiment of the instant invention, adjustable stationary deflectors (19) positioned above the conveyor in such a manner that strands projected from each feeder impinge upon their surface and then fall toward the surface of the moving conveyor, where the strands assume a random orientation, are used.

The feeders (15) are caused to reciprocate or traverse back and forth across the conveyor (13) by means of a chain or cable (28) which is driven by a belt (29) connected to a reversible electric motor (30), preferably an indexing or brushless stepper motor described below. Each feeder (15) rides within a track (31) as it reciprocates across the moving conveyor (13). Typically, the speed of reciprocation of the feeder across the width of the conveyor is within the range of about 75 to 200 feet per minute and the feeder traverses in a direction generally perpendicular to the direction of motion of the conveyor surface (13). The pay-out rate of strand (6) from each feeder (15) is typically within the range of about 1000 to 5000 feet per minute.

Figure 5:
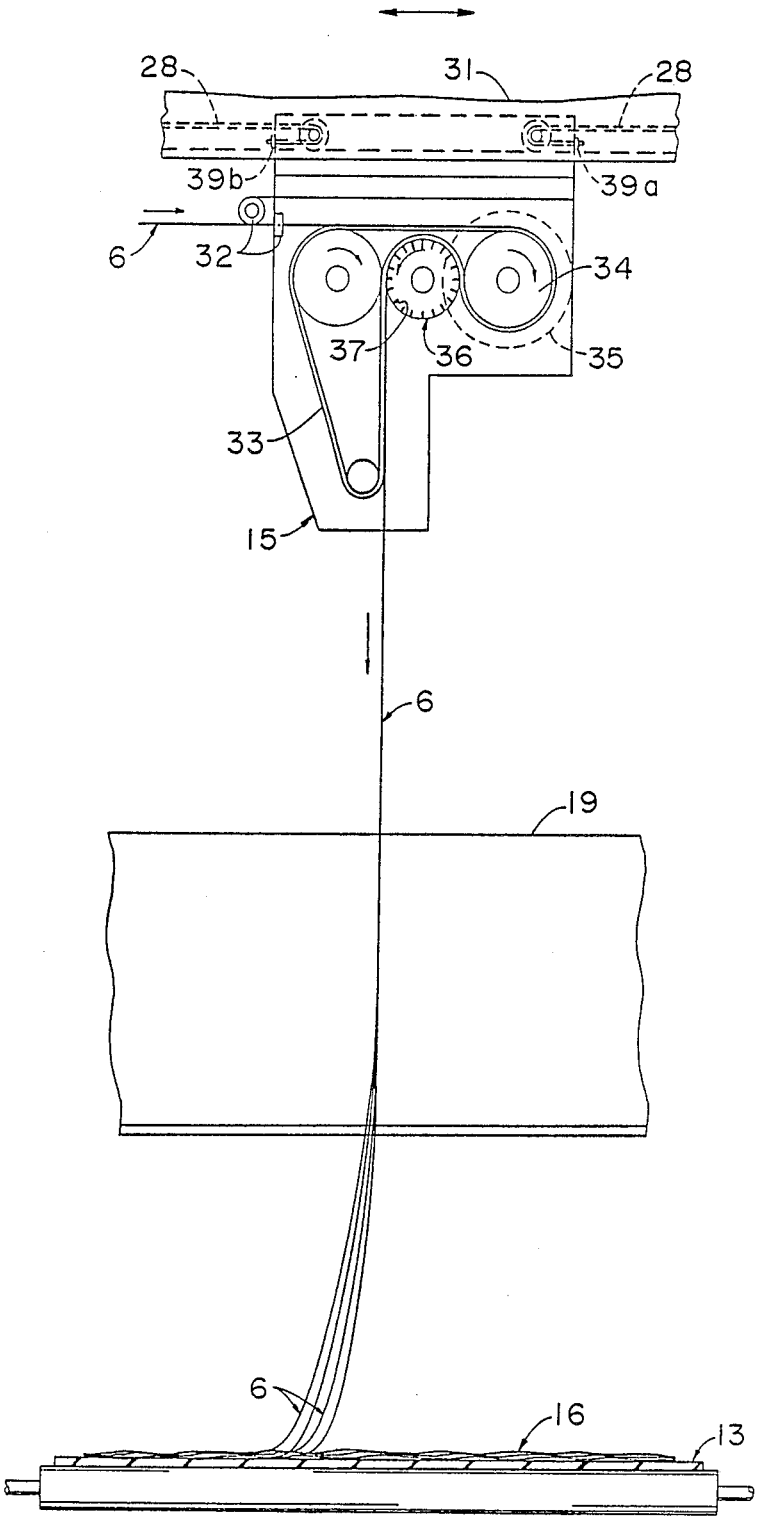
FIG. 5 is an elevational view of a reciprocating feeder, stationary deflector and strand being deposited onto a moving conveyor.

Turning to FIG. 5, a detailed view of the strand feeder is illustrated. Strand (6) provided from previously made forming packages is guided by a plurality of ceramic eyelets (32) so as to pass along the outside surface of a flexible belt (33). The exact width of the belt may vary to accommodate the number of individual strands to be advanced by the feeder. The belt (33) and strand (6) are passed around a rotating cylindrical hub (34). The cylindrical hub (34) is driven by a variable speed electric motor (35). In the preferred embodiment, this motor is a three-phase A.C. induction motor.

As the strand (6) passes around the driven cylindrical hub (34) on the outside surface of the belt (33), the belt is caused to advance by friction generated between its inside surface and the hub (34). The belt (33) and strand (6) progress from the driven cylindrical hub (34) to a cylindrical cage (36) which is free-wheeling about a ball bearing (not shown). The cage (36) also has a plurality of pins or bars (37), protruding from its surface which run axially along its length. The strand (6) contacts these bars and is thus pinched between them and the outer surface of the belt (33). This produces the tractive force necessary to advance the strand (6) from the individual forming packages (9) which supply each feeder (15). Since the strand (6) contacts the cage (36) only at the bars (37), rather than along an entire continuous surface, the strand does not adhere to the bars (37) with the same tenacity as it would to a continuous surface. This helps prevent what are known as strand wraps which result in interruptions of the process. Since the strand (6) is carried between the outside surface of the belt (33) and the flight bars (37) while the belt is driven by the cylindrical hub (34) from its inside surface, the useful life of both surfaces of the belt is greatly increased.

DETAILED DESCRIPTION OF THE INVENTION

In the operation of the feeder, a brushless stepper motor (30) is used to cause the feeder (15) to reciprocate back and forth across the width of the conveyor as shown in FIG. 4. A flexible drive belt or chain (29) connects the output shaft of the stepper motor (30) with a first rotatable pulley or drum (38), about the circumference of which is wrapped a second flexible chain or, preferably, a stranded steel cable (28). The cable is of a length substantially twice the width of the conveyor. One end of the cable is firmly attached to one side of the frame of the feeder (39*a*) as shown in FIG. 5. The cable is then wrapped once or twice around the circumference of the driven drum (38), brought across the width of the conveyor and over a second free-turning idler drum (40) where the opposite end of the cable is attached to the other side of the feeder frame (39*b*). Thus, as the driven drum (38) shown in FIG. 4 is rotated clockwise by means of the stepper motor (30), the feeder will advance to the left. If stepper motor reverses its direction and turns the drum (38) counter-clockwise, the feeder will advance towards the right.

The brushless stepper motor (30) used to reciprocate the feeder must be capable of generating enough torque to overcome the momentum associated with the moving feeder (15) in order to reverse its direction quickly. The wire cable or chain (28) must also be capable of withstanding the stress associated with the reversal of the feeder apparatus.

A brushless stepper motor such as Model No. 112-FJ326 manufactured by Superior Electric Company of Bristol, Conn. was used in the preferred embodiment of the instant invention; however, any stepper motor capable of generating sufficient torque to overcome the momentum associated with the moving feeder apparatus may also be substituted.

Unlike a conventional A.C. or D.C. electric motor, the use of a stepper motor possesses several advantages. Among these are the fact that a stepper motor contains no brushes which must be periodically removed and cleaned; it also operates with greater speed, faster acceleration/deceleration rates, a better power to weight ratio and with greater reliability than conventional motors.

A brushless stepper motor is similar to an A.C. motor in that a moving magnetic field is produced in its stator windings while a permanent magnet is used for the rotor. As the stator windings are sequentially energized to produce a rotating magnetic field, the rotor turns and tries to keep up with it. A controller is used to switch the stator field by de-energizing one winding and energizing another. This is done by an amplified sequence of chopped D.C. current or pulses, also referred to as indexing commands, which are fed to the appropriate windings of the stepper motor in order to induce the rotation of the rotor by a fixed amount. The individual indexing commands or pulses are generated by an oscillator circuit. In the case of the motor used in the preferred embodiment, each pulse causes the rotor to advance by 1.8° and thus 200 such pulses will result in one complete revolution of the motor. Because of the particular dimensions of the belts, pulleys, etc. used in the instant invention, each revolution of the stepper motor causes the feeder to advance about two inches across the width of the conveyor. By first determining the desired width of the mat to be made and knowing the advance that each revolution of the stepper motor will cause the feeder to traverse along its track, as well as the number of indexing commands necessary to rotate the motor by one revolution, it is possible to control the motion of the feeder by determining the total number of indexing commands which must be sent to it in order to cause it to advance a specified distance. For example, if it were desired to form a mat six feet in width and it is known that the feeder advances two inches across the width of the conveyor per revolution of the motor, then it is necessary to send 7,200 index commands from the oscillator to the stepper motor in order to cause the feeder to advance six feet.

Another particularly attractive feature of stepper motors is their rapid acceleration and deceleration characteristics. For example, the motor used in the preferred embodiment can be accelerated from 105 to 3000 rpm in about 370 milliseconds. This rapid rise time, as well as the high torque output of the motor, makes since it possible to rapidly and smoothly reverse each of the moving feeders (15) without excessive jerking, vibration, or the need to rely upon mechanical devices such as shock absorbers or gas pistons.

Figure 6:
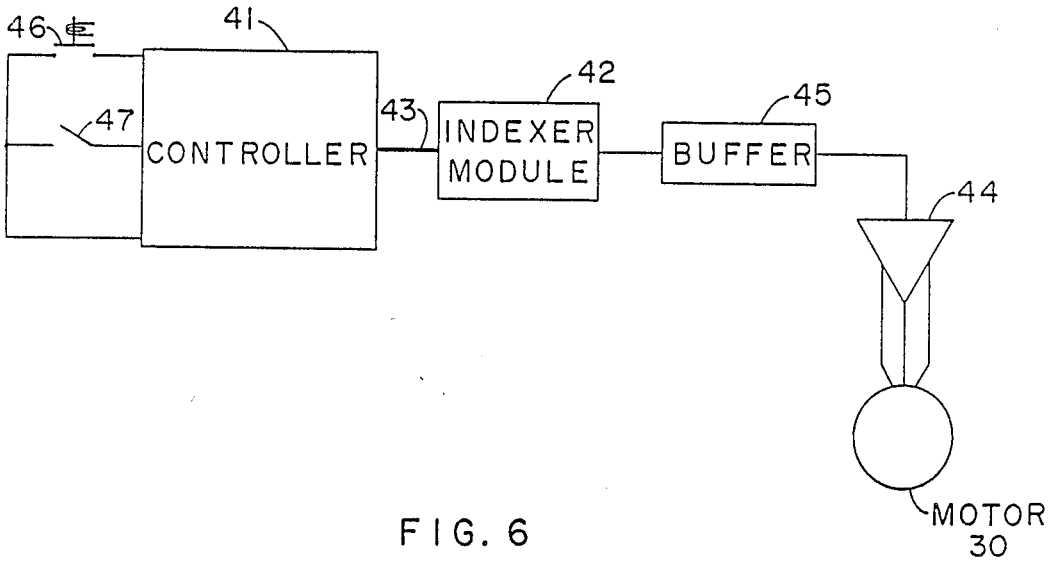
FIG. 6 illustrates, in block diagram form, the electrical circuit used to control the acceleration and deceleration of each reciprocating feeder.

The electrical circuit used to control the stepper motor is illustrated in FIG. 6 in block diagram form. An EPTAK 700 programmable controller (41) was used to determine the number of pulses necessary to advance the feeder a given distance across the width of the conveyor surface. The EPTAK 700 is a form of a programmable logic controller manufactured by the Eagle Signal Corporation. The actual distances that the feeder must traverse both left and right of an imaginary centerline are entered into the EPTAK through a plurality of thumb wheel switches which convert this information into binary coded decimal (BCD) form. The EPTAK internally calculates the total number of indexing commands or pulses necessary to advance the feeder back and forth in much the same manner as described above. This BCD information is then supplied to an indexer module (42) by means of a digital bus (43) and an internal oscillator within the indexer module generates the appropriate number of indexing commands to turn the stepper motor (30) in a clockwise or counter-clockwise direction. In the preferred embodiment, the indexer module is also capable of altering the frequency or repetition rate of the indexing commands so that the feeder may be accelerated or decelerated near the ends of each traverse cycle. In the instant invention, the indexer module used was a Slo-Syn Preset Indexer Module Type PIM153, manufactured by Superior Electric Company of Bristol, Conn. However, any such similar commercially available device for controlling the motion of a stepper motor may also be used.

The index commands or pulses generated by the internal oscillator of the indexer module are amplified to increase their voltage prior to being applied to the stator windings of the stepper motor. In the preferred embodiment, an amplifier, also known in the art as a translator, is a Slo-Syn TM600U translator (44), also manufactured by Superior Electric Company. However, because of the actual physical distances between the location indexer module and amplifier used in the instant invention, a buffer (45) was also used to isolate the pulse signals from any extraneous noise and reduce the output impedance of the indexer module to zero. A buffer chip, such as SN75451BP, manufactured by Motorola, was used in the instant invention to accomplish this although any such similar device may be substituted to achieve the same results.

Located above the conveyor on each feeder track (31) and midway across the width of the conveyor surface is an electromagnetic proximity switch or sensor (46). Each time the feeder (15) passes the proximity sensor causing it to close, a signal is transmitted to the EPTAK controller (14), which is interpreted as meaning that the feeder has completed one-half of a traverse cycle. In commercial applications where up to 12 feeders have been used to work in harmony with one another in order to produce mat having a uniform density distribution, the controller (41) may be programmed to recognize a preset sequence of signals from the centerline sensors associated with each individual feeder. Should the signal sequence detected by the controller (41) not be in agreement with the preprogrammed one, then the controller will interpret this as a malfunction in one of the feeders (15) and take corrective action. For example, if the controller were preprogrammed to expect a certain sequence of cross-over signals from feeders 1, 3 and 2 (in that order), and instead it only acknowledged the receipt of a signal from feeders 1 and 2, then the controller (41) would recognize that the receipt of a cross-over signal from feeder 2 where one was expected from feeder 3 instead meant that a potential problem may exist, such as a stalled motor or jammed feeder which caused the sequence to be other than the one expected. The controller would then signal the startup of an extra feeder located at a position further down the conveyor in order to make up for the amount of strand not deposited on it due to the failure of the third feeder. In commercial applications, up to 12 active feeders have been used simultaneously with as many as four additional make-up feeders.

In order to ensure the proper startup and sequencing of the feeders when many are used simultaneously with one another, a limit switch (47) located on one side of the track (31) is provided for each feeder. The purpose of the this limit switch (47) is to indicate a home position for the feeders (15) by sending a signal to the EPTAK controller (41). Once the controller senses that the feeders are in their home position as indicated by the status of each home limit switch (47), the controller (41) will cause the indexer module (42) to jog each feeder into an appropriate starting position prior to their beginning an automatic traverse of the conveyor. The controller (41) will then issue a command at the appropriate time to cause each feeder to begin independently traversing the width of the conveyor. The feeders are preferably started and timed in such a sequence such that strands thrown from immediately adjacent feeders do not overlap each other.

Figure 7:
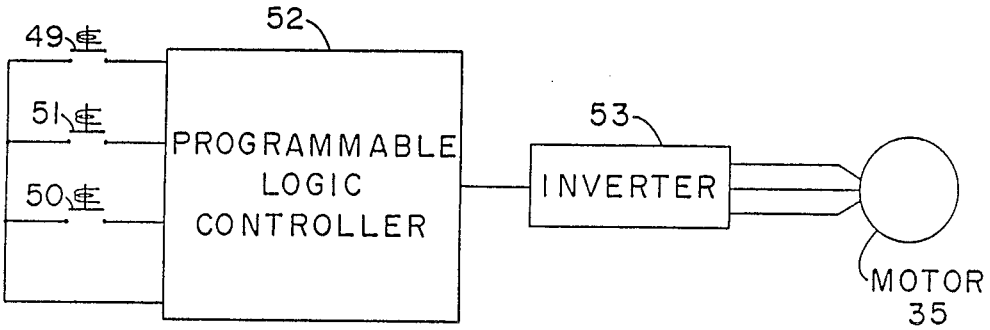
FIG. 7 illustrates, in block diagram form, the electrical circuit used to control the rate at which strand is deposited from each reciprocating feeder onto a moving conveyor.

Three other electromagnetic proximity sensors are also used to indicate the relative position of each feeder during its traverse across the conveyor. These proximity sensors are used to control the rate at which strand (6) is advanced through the feeder from the supply source and onto the conveyor. Two sensors (49 and 50) are located at opposite ends of the track just short of the edges of the mat while the third (51) is located near the centerline of the chain conveyor (13). In order to avoid non-uniform strand density near the mat edges, the use of these proximity sensors permits the feeder motor (35) and thus the throw rate of the strand to be slowed. This automatic reduction in the throw rate is accomplished by means of a second programmable logic controller (52) and an A.C. frequency inverter (53). The details of this arrangement can best be understood by consulting FIG. 7, which illustrates the circuit in block diagram form.

When an "off-on-off" signal sequence from the central sensor (51) is followed by an "off-on-off" signal from either one of the side sensors (49 or 50), the programmable logic controller (52) (hereinafter referred to as a "PLC") sends an output signal to the inverter to drop to a digitally adjustable preset frequency. This slows down the feed rate of the feeder motor (35), which is a conventional 480 volt electric A.C. three-phase induction motor. When an "off-on-off" signal from one of the side sensors is then immediately followed by an "off-on-off" signal from the same sensor, the PLC triggers the inverter to return to operating at its higher, original, digitally preset frequency. When this signal is then immediately followed by an "off-on-off" signal again from the central sensor (51), the PLC resets itself to again decrease the feed rate by lowering the inverter frequency upon receiving an "off-on-off" signal from the other side sensor. This control logic is repeated with every traverse of the feeder mechanism across the conveyor. In the instant invention, an Allen-Bradley SLC-100 programmable logic controller was used to control the inverter and to perform the appropriate switching functions according to the logic sequence just described. The PLC is a device programmable using conventional relay-ladder language. The inverter used was an Allen-Bradley 1333-AAB inverter capable of powering a one horse-power, 480 volt, three-phase A.C. induction motor over a frequency range of 0.5 to 70 Hz at a ratio of 7.6 v/Hz.

The use of the instant invention in the production of two different types of glass fiber mats will now be illustrated in detail.

EXAMPLE 1

Figure 8:
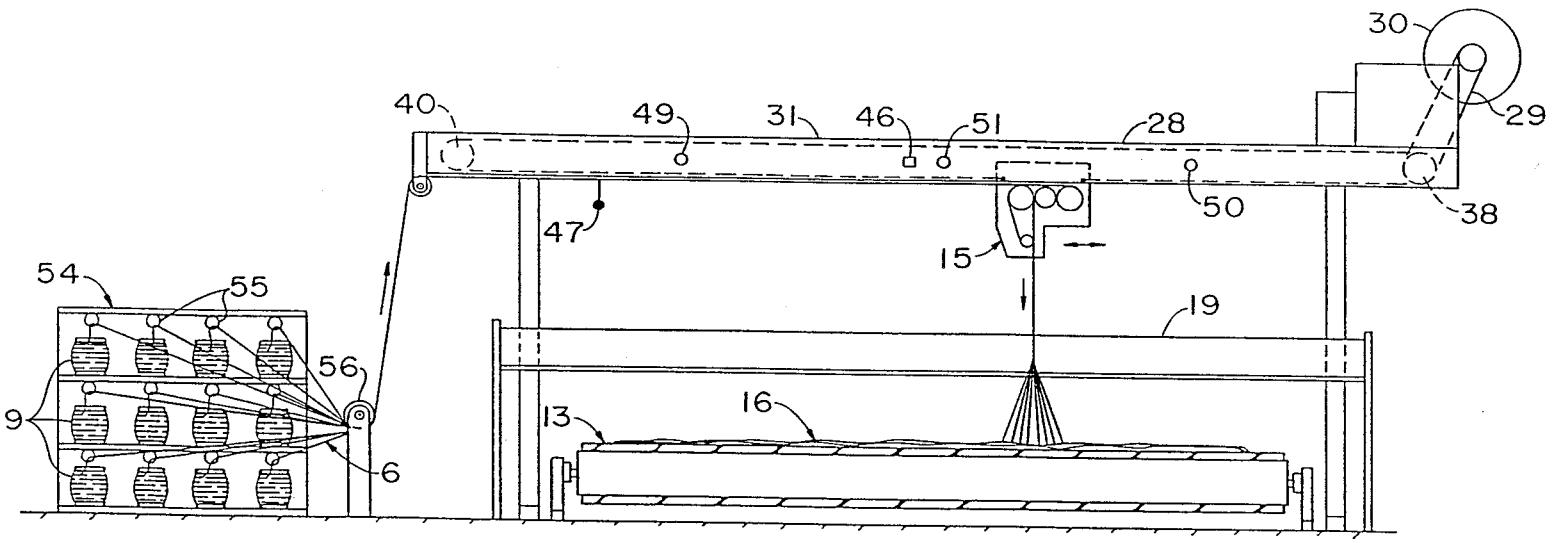
FIG. 8 is a front elevational view of a typical mat line taken along Section 8—8 of FIG. 3 further illustrating the orientation of the components associated with each reciprocating feeder.

In a typical application of the instant invention to produce a needled fiber glass continuous strand mat having uniform mechanical properties, glass strands are deposited onto the conveyor by a plurality of reciprocating strand feeders as illustrated in FIG. 8. Forming packages (9) of strand were held by means of a creel (54). Multiple strands (6) are passed through ceramic eyelet guides (55) and through a guide bar (56). The strands (6) are then passed to the strand feeders (15). Between the time of their leaving the creel (54) and entering the feeder (15), the strands may be wet with water or some other liquid antistatic agent to reduce the buildup of static electricity. Typically, the strands should have between about a 5 to 15 percent moisture content by weight. This helps to reduce any tendency of the strand to break and wrap itself around the belt-driven feeder. Generally, the use of an antistatic agent such as Triton X-100 which is a nonionic octylphenoxy polyethoxy ethanol surfactant is recommended when the strand is supplied from extremely dry forming packages which have been stored for several months.

An oven (17) is used to evaporate any excess moisture. Mat exiting the oven is then passed to a needling loom (18) where the strand is needled together in order to entangle it and impart sufficient mechanical integrity to allow the subsequent processing and handling of the finished mat.

In the fiber glass strand mat which was produced, randomly deposited strands of "T" fibers were supplied from T11.5 forming packages having about 400 fibers per strand with one pound containing about 1150 yards of strand. (The use of this designation is well known in the art and indicates that each individual glass fiber has a diameter on the order of 90 to 95 microns.)

The conveyor surface moved at a uniform rate of about 12 feet per minute and stationary deflectors (19) were also employed.

The feeders were reciprocated once every 6 seconds back and forth over a distance of about 90 inches at a mean velocity of about 160 to 165 feet per minute. The induction motor (35) contained in the feeder advanced the continuous strand supplied by the forming packages at a rate of between 1250 to 1300 feet per minute and preferably at about 1270 feet per minute. The terminal proximity sensors (49 and 50) used to trip each inverter were each located on the track about 9 inches just after the start, and about 9 inches just before the termination of, the 90-inch traverse stroke. Tripping the inverter caused the frequency and voltage supplied to the feeder motor (35) to drop so that the feed rate of the glass strand was reduced by 80 percent to between 250 to 260 feet per minute, preferably about 254 ft/min.

A total of 12 reciprocating feeders were used although only two were equipped with the variable speed induction motors (35) since it was found that this number of feeders provided sufficient compensation for the others so as to achieve mat of essentially uniform thickness. In order to produce a mat having a density of about 3 ounces per square foot, 6 ends of T11.5 strand were provided to each feeder so that about 1348 lb/hr of glass was deposited onto the surface of the conveyor. In order to produce a mat having a density of about 2 ounces per square foot, 4 ends of strand were provided so that only 905 lb/hr was deposited on the conveyor.

An oven (17) heated to about 105° F. and enclosing about a 20-foot length of the conveyor was used to evaporate excess moisture from the loosely formed mat. The mat was then stretched and passed to a needle loom (18) at a speed of about 16 ft/min. The needle loom (18) had a lineal needle density of about 114 needles per inch. The needles were reciprocated to yield a penetration density of about 140 penetrations per square inch to a depth of about 0.45 inches.

EXAMPLE 2

It has been found desirable in some applications to produce a mat having anisotropic or uni-directional material properties. A mat having directionally dependent mechanical properties such as tensile strength may be used to subsequently reinforce laminates which are used in the production of tire rims, automotive bumpers, or any structure in which it is desired that one direction have an enhanced tensile strength.

Figure 9:
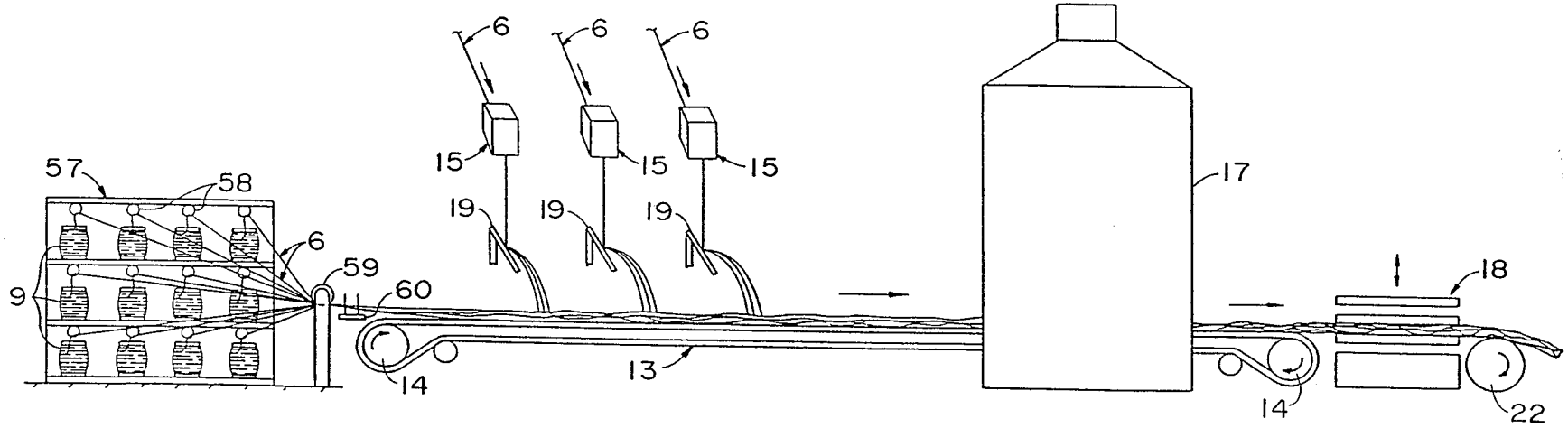
FIG. 9 is a side elevational view of a typical mat line configured for making a mat comprised of a layer of randomly oriented strands needled to a layer uniformly oriented, parallel strands.

In the production of a mat having such directionally dependent mechanical properties, several thousand individual filaments in the form of strand were fed out onto the moving conveyor (13) and pulled along in the same direction of motion as the conveyor and in such a manner so as to lie substantially parallel to one another. As shown in FIG. 9, the strand (6) may be supplied from individual forming packages held by a creel (57) located at the front of the conveyor, however, the use of heavier strand in the form of roving packages is preferred. The strands (6) are passed through a plurality of ceramic eyelets (58) located on the creel (57) and brought through an eyeboard (59) also located at the front of the conveyor (13). The strands are then pulled through both the eyeboard and the tines of an accordion-like precision adjustable comb (60) also located just in front of the conveyor. The comb is used to provide a uniform number of strands per inch across the width of the mat and may also be adjusted to provide different lineal strand densities depending upon the particular mat being made.

Additional strands (6) are supplied to each reciprocating feeder (15) from some other source such as a fiber glass bushing or individual forming packages (9) as illustrated in FIG. 8. As these strands are advanced toward the surface of the conveyor (13) by the feeders (15), the weight of their build-up atop the first layer of strnds which are already moving in the direction of the conveyor tends to hold and maintain them in a substantially parallel orientation. It is preferred that the strands projected by the reciprocating feeders (15) be impinged upon the surface of a stationery deflector (19) just prior to their being deposited onto the conveyor. This results in a loosely bound mat having an upper layer of randomly oriented continuous strand and a bottom layer of substantially parallel strand. These loosely bound layers may then be passed through an oven (17) similar to that described in Example 1 to remove any excess moisture. Mat exiting the oven is then passed to a needling loom (18) where the upper and lower layers are needled together in order to entangle the strands and impart sufficient mechanical integrity to them to allow the subsequent processing and handling of the finished mat.

The mat may have a weight content of anywhere from 40 to 60 percent of aligned parallel strand fibers and anywhere from abuot 60 to 40 percent of randomly deposited continuous strand. In the fiber glass strand mat which was produced, about 55 percent of the mat contained aligned parallel strand and the remaining 45 percent was randomly deposited by the variable rate feeders (15) described herein. The parallel strand was supplied from direct-draw T2.50 roving packages having about 1600 "T" fibers per strand. (The use of this designation is well known in the art and indicates that each individual glass fiber has a diameter on the order of 90 to 95 microns and that one pound of this particular roving contains about 250 yards of strand.) The precision adjustable comb (60) was set to provide anywhere from about 7 to 8 strands per inch across about a 100-inch width of the conveyor surface. The randomly deposited strand was also a "T" fiber supplied from T11.5 forming packages having about 400 fibers per strand with one pound containing about 1150 yards of strand.

The conveyor surface moved at a uniform rate of about 12 feet per minute and stationary deflectors (19) were also employed.

The feeders were reciprocated once every 6 seconds back and forth over a distance of about 90 inches with a mean velocity of about 160 to 165 feet per minute. The induction motor (35) carried by the feeder advanced the continuous strand supplied from the forming packages at a rate of between 1250 to 1300 feet per minute and preferably at about 1270 feet per minute. The terminal proximity sensors (49 and 50) used to trip each inverter were each located on the track about 9 inches just after the start, and about 9 inches just before the termination of, the 90-inch traverse stroke. Tripping the inverter caused the frequency and voltage supplied to the feeder motor (35) to drop so that the feed rate of the glass strand was reduced by 80 percent to between 250 to 260 feet per minute, preferably about 254 feet per minute.

A total of 12 reciprocating feeders were used although only two were equipped with the variable speed induction motors (35) since it was found that this number of feeders provided sufficient compensation for the others so as to achieve mat of essentially uniform thickness. In order to produce a mat having a density of bout 3 ounces per square foot, 3 ends of T11.5 strand were provided to each feeder so that about 607 lbs/hr of glass was deposited onto the surface of the conveyor.

An oven (17) heated to about 105° F. and enclosing about a 20-foot length of the conveyor was used to evaporate excess moisture from the loosely formed mat. The mat was then passed to a needle loom (18) at a speed of about 12.1 ft/min. The needle loom (18) had a lineal needle density of about 114 needles per inch. The needles were reciprocated to yield a penetration density of about 140 penetrations per square inch to a depth of about 0.45 inches.

Test samples cut from the needled mat described herein had about a 3 to 4 percent improvement in the coefficient of variation of mat density by reducing it from 7 to about 4 percent or lower.

Although, the above examples have relied upon the needling of the strands in order to impart mechanical integrity to the loose mat structure, it is a common practice well known in the art to deposit powdered resin particles onto the mat and then subsequently heat it in order to bond the strands and resin together rather than rely upon mechanical bonding produced by needling. In order to impregnate a continuous glass strand mat, it is usually sufficient to deposit the resin by sprinkling it directly upon the mat by means of a trough and an agitator, also well known in the art, just prior to the point where the mat enters the oven and is heated to a temperature sufficient to melt the resin. The mat and resin are then solidified by means of chill rollers, also well known in the art. The use of a resin such as AT-LAC-300, manufactured by ICI-USA, Inc. is particularly well suited for this application. It is contemplated that the methods described above used to control the strand feeders may also be used to produce resin-bonded mats having similarly reduced density and thickness variations.

While the mats described in the disclosure and proceeding examples have all been illustrated as being made from fiber glass strand, it is not intended that the methods of the instant invention is necessarily limited thereto. For example, the same methods described herein may be used in the production of mats made from any other natural or synthetic fibers as well as glass. Strands composed of nylon, polyester, and the like, may also be substituted or mixed with one another as well as with packages carrying glass fibers.

Also, while the use of certain specific electrical components has been described, it is not intended that they be necessarily limiting since all are commercially available devices and other similar devices may be readily substituted to achieve substantially the same results. For example, the use of electro-magnetic proximity sensors to detect the moving feeders and trip the inverters also contemplates the use of magnetic proximity sensors, photo-electric sensors, electro-optical sensors, and mechanical limit switches. Also the use of a frequency inverter to control the speed of an electric motor is not strictly limited to the control of a three-phase induction motor since any two or three-phase electric motor capable of varying its speed in response to a frequency inverter is contemplated as well.

Therefore, while this invention has been described with respect to certain specific embodiments and components and illustrated with its application to the production of certain products, it is not intended to be so limited thereby except insofar as set forth in our accompanying claims.

We claim:

1. In a method for making a mat of continuous fiber strands by traversing at least one strand feeder back and forth across the surface of a moving conveyor, said strand feeder advancing at least one strand from a supply source and depositing it onto the surface of said conveyor, the improvement comprising: sensing the relative position of said strand feeder with respect to its location across the width of said moving conveyor; by detecting a signal emitted by at least one sensor in response to the momentary juxtaposition of said feeder and sensor with one another whereby the frequency and voltage supplied to a rotating electric motor is altered thereby causing said motor to rotate at a different speed and deposit strand at a different rate from said feeder so as to form a mat having substantially uniform thickness and density.

2. The method of claim 1 wherein said strands are strands of glass fibers.

3. The method of claim 1 wherein said supply source of strand is a fiber glass bushing issuing a plurality of individual streams of molten glass which are cooled, attenuated, and subsequently gathered into at least one continuous strand of glass fibers.

4. In a method for making a mat of continuous fiber strands by traversing at least one strand feeder back and forth across the surface of a moving conveyor, said strand feeder advancing at least one strand from a supply source and depositing it onto the surface of said conveyor, the improvement comprising: sensing the relative position of said strand feeder with respect to its location across the width of said moving conveyor; and, changing the rate at which strand is deposited onto the surface of said conveyor in response to the relative position of said strand feeder across the width of said conveyor so as to form a mat having substantially uniform thickness and density.

5. The method of claim 4 wherein the rate of which strand is deposited onto the surface of said conveyor by said strand feeder is changed by detecting a signal emitted by at least one sensor in response to the momentary juxtaposition of said feeder and sensor with one another whereby the frequency and voltage supplied to a rotating motor is altered thereby causing said motor to rotate at a different speed and advance strand at a different rate from said strand feeder.

6. The method of claim 5 further comprising the step of: needling said mat so as to entangle said strands together with one another thereby forming a mat having improved uniformity of its mechanical properties and sufficient strength to withstand subsequent processing and handling.

7. The method of claim 6 wherein said strands are strands of glass fibers.

8. The method of claim 6 wherein said source of strand is a fiber glass bushing issuing a plurality of individual streams of molten glass which are cooled, attenuated, and subsequently gathered into at least one continuous strand of glass fibers.

9. The method of claim 5 further comprising the steps of: sprinkling a powdered resin onto said mat; and, heating said mat and resin so as to cause said resin to melt and bond individual strands together with one another thereby forming a mat having improved uniformity of its mechanical properties and sufficient strength to withstand subsequent processing and handling.

10. The method of claim 9 wherein said strands are strands of glass fibers.

11. The method of claim 9 wherein said source of strand is a fiber glass bushing issuing a plurality of individual streams of molten glass which are cooled, attenuated, and subsequently gathered into at least one continuous strand of glass fibers.

12. In a method for making a mat of continuous fiber strands by passing a first layer of aligned strands from a first supply source and onto the surface of a moving conveyor, pulling said strands along in the same direction of motion as said conveyor, traversing at least one strand feeder back and forth across the surface of said conveyor and first layer of strands, said feeder advancing at least one strand from a second supply source and depositing it atop said first layer of aligned strands and subsequently needling both said first and second layers of strands together so as to entangle them thereby forming a mat having anisotropic mechanical properties, the improvement comprising: sensing the relative position of said feeder with respect to its location across the width of said conveyor by detecting a signal emitted by at least one sensor in response to the momentary juxtaposition of said feeder and sensor with one another; and, changing the rate at which strand is advanced from said second supply source and deposited onto said first layer of aligned strands by changing the speed of a rotating motor thereby causing said motor to deposit strand at a different rate from said strand feeder onto the surface of said conveyor so as to form a mat of substantially uniform thickness and density.

13. The method of claim 12 wherein said strands are strands of glass fibers.

14. The method of claim 12 wherein said second supply source of strand is a fiber glass bushing issuing a plurality of individual streams of molten glass which are cooled, attenuated, and subsequently gathered into at least one continuous strand of glass fibers.

15. In a method for making a mat of continuous fiber strands by traversing at least one strand feeder back and forth across the surface of a moving conveyor, said strand feeder advancing at least one strand from a supply source and depositing it onto the surface of said conveyor, the improvement comprising: sensing the relative position of said strand feeder with respect to its location across the width of said moving conveyor; by detecting a sequence of signals emitted by at least one sensor in response to the momentary juxtaposition of said strand feeder and sensor; and, processing the sequence of signals emitted from said sensor whereby the frequency and voltage supplied to a rotating electric motor is altered thereby causing said motor to rotate at a different speed and deposit strand at a different rate from said feeder onto the surface of said conveyor so as to form a mat having substantially uniform thickness and density.

16. The method of claim 15 wherein said strands are strands of glass fibers.

17. The method of claim 15 wherein said supply source of strand is a fiber glass bushing issuing a plurality of individual streams of molten glass which are cooled, attenuated, and subsequently gathered into at least one continuous strand of glass fibers.

18. The method of claim 4 wherein the rate at which strand is deposited onto the surface of said conveyor by said strand feeder is changed by detecting a sequence of signals emitted by at least one sensor in response to the momentary juxtaposition of said strand feeder with said sensor; and, processing the sequence of signals emitted from said sensor whereby the speed of a rotating motor is altered thereby causing said motor to advance strand at a different rate from said feeder.

19. The method of claim 18 further comprising the step of: needling said mat so as to entangle said strands together with one another thereby forming a mat having improved uniformity of its mechanical properties and sufficient strength to withstand subsequent processing and handling.

20. The method of claim 19 wherein said strands are strands of glass fibers.

21. The method of claim 19 wherein said source of strand is a fiber glass bushing issuing a plurality of individual streams of molten glass which are cooled, attenuated, and subsequently gathered into at least one continuous strand of glass fibers.

22. The method of claim 18 further comprising the steps of: sprinkling a powdered resin onto said mat; and, heating said mat and resin so as to cause said resin to melt and bond individual strands together with one another thereby forming a mat having improved uniformity of its mechanical properties and sufficient strength to withstand subsequent processing and handling.

23. The method of claim 22 wherein said strands are strands of glass fibers.

24. The method of claim 22 wherein said source of strand is a fiber glass bushing issuing a plurality of individual streams of molten glass which are cooled, attenuated, and subsequently gathered into at least one continuous strand of glass fibers.

25. In a method for making a mat of continuous fiber strands by passing a first layer of aligned strands from a first supply source and onto the surface of a moving conveyor, pulling said strands along in the same direction of motion as said conveyor, traversing at least one strand feeder back and forth across the surface of said conveyor and first layer of strands, said feeder advancing at least one strand from a second supply source and depositing it atop said first layer of aligned strands and subsequently needling both said first and second layers of strands together so as to entangle them thereby forming a mat having anisotropic mechanical properties, the improvement comprising: sensing the relative position of said feeder with respect to its location across the width of said conveyor by detecting a sequence of signals emitted by at least one sensor in response to the momentary juxtaposition of said strand feeder and sensor; processing the sequence of signals emitted from said sensor; and, changing the rate at which strand is advanced from said second supply source and deposited onto said first layer of aligned strands by changing the speed of a rotating motor thereby causing said motor to deposit strand at a different rate from said feeder and onto the surface of said conveyor so as to form at mat of essentially uniform thickness and density.

26. The method of claim 25 wherein said strands are strands of glass fibers.

27. The method of claim 25 wherein said second supply source of strand is a fiber glass bushing issuing a plurality of individual streams of molten glass which are cooled, attenuated, and subsequently gathered into at least one continuous strand of glass fibers.

* * * * *